US008656979B2

(12) United States Patent
Tierney

(10) Patent No.: US 8,656,979 B2
(45) Date of Patent: Feb. 25, 2014

(54) PET DOOR PEST AND DEBRIS BARRIER

(76) Inventor: Bruce Donald Tierney, Irvine, CA (US)

( * ) Notice: Subject to any disclaimer, the term of this patent is extended or adjusted under 35 U.S.C. 154(b) by 313 days.

(21) Appl. No.: 13/050,869

(22) Filed: Mar. 17, 2011

(65) Prior Publication Data

US 2011/0225892 A1 Sep. 22, 2011

Related U.S. Application Data

(60) Provisional application No. 61/315,939, filed on Mar. 2, 2010.

(51) Int. Cl.
*E06B 7/16* (2006.01)

(52) U.S. Cl.
USPC ..... 160/43

(58) Field of Classification Search
USPC ..... 160/43, 40, 41, 42; 49/475.1, 472, 470, 49/506
See application file for complete search history.

(56) References Cited

U.S. PATENT DOCUMENTS

| | | | | | |
|---|---|---|---|---|---|
| 2,612,947 | A * | 10/1952 | Jenks | 160/40 |
| 2,738,559 | A * | 3/1956 | Edwards, Jr. | 49/495.1 |
| 3,023,804 | A * | 3/1962 | Howell, Sr. | 160/40 |
| 3,535,824 | A * | 10/1970 | Kessler | 49/475.1 |
| 3,685,206 | A * | 8/1972 | Kessler | 49/489.1 |
| 4,497,137 | A * | 2/1985 | Nelson | 49/496.1 |
| 5,010,691 | A * | 4/1991 | Takahashi | 49/482.1 |
| 5,475,946 | A * | 12/1995 | Howe | 49/470 |
| 5,983,570 | A * | 11/1999 | Brown | 49/475.1 |
| 6,691,483 | B2 * | 2/2004 | Lethers | 52/455 |
| 7,063,123 | B2 * | 6/2006 | Lethers | 160/180 |
| 7,363,956 | B2 * | 4/2008 | Lethers | 160/180 |
| 2010/0058670 | A1 * | 3/2010 | Rissone | 49/495.1 |

* cited by examiner

*Primary Examiner* — Katherine Mitchell
*Assistant Examiner* — Johnnie A Shablack
(74) *Attorney, Agent, or Firm* — Coastal Patent Law Group, P.C.; Joshua S. Schoonover, Esq.

(57) ABSTRACT

A barrier device preventing access of pests such as mosquitoes, flies, and other small animals as well as debris between a panel pet door and a screen door by providing a seal between the panel pet door and the screen door. The barrier material may have ribs for the purpose of added stiffening or as a guide for adjusting the reach of the barrier. A stopping device may be used to ensure the screen door is closed to a location where good contact is made with the barrier device.

20 Claims, 5 Drawing Sheets

PET DOOR PEST AND DEBRIS BARRIER

CROSS-REFERENCE TO RELATED APPLICATION

This utility patent application claims priority to U.S. Provisional Patent Application No. 61/315,939, filed on Mar. 20, 2010, entitled "Pet Door Bug and Debris Blocker," the benefit of which is claimed under 35 U.S.C. 119, and is further incorporated herein by reference.

FIELD OF THE INVENTION

The present invention relates generally to pet doors and screen doors and more particularly to blocking the entry of bugs/insects, small animals, dirt, and unwanted extraneous materials entering the gap between a pet door and a screen door.

BACKGROUND

Panel pet doors for sliding doors are installed in the existing tracks of a sliding door to allow a pet (typically a dog or cat) to enter or exit a home through a pet door.

An example of a panel pet door is described in the following U.S. patents entitled "Adjustable Pet Door" to E. Alan Lethers: 7363956, 7063123, and 6691483, each of which is hereby incorporated herein by reference in its entirety.

The panel pet door shown in FIG. 1, item 3 is often similar in height to the sliding door 1 and is placed in the same sliding rails as the sliding door. The pet door 4 is located near the bottom of the panel pet door 3 providing access for the pet into or out of the home.

When a panel pet door is installed adjacent to a sliding door, the screen door 2 must be left open the width 5 of the pet door opening to prevent the screen door from blocking the passage of the pet into or out of the home. On a warm day, a sliding door may be opened to allow fresh air to enter the home, and with the screen door only partially closed, a large gap 6 exists between the panel pet door 3 and the partially closed screen door 2. This gap is often 3 inches wide by approximately 7 feet tall (over 250 square inches) allowing bugs/insects (mosquitoes, flies, lizards, spiders, etc.) and other extraneous materials including leaves and more to enter the home.

Due to the wide variation in pet doors and sliding door/screen door combinations, there is also a wide variation in the width of the gap between the screen door and the pet door. Double paned sliding glass doors for example, typically result in a larger gap than single paned sliding doors. For this reason, there is a need for a solution that supports easy customization of gap width for each pet door/screen door combination.

Since an embodiment providing a solution to this gap occurs adjacent to where a person walks in and out of the sliding door, there is a need for a solution that will minimize the risk of injury if the person accidentally bumps into the invention.

BRIEF SUMMARY OF THE INVENTION

One aspect of this invention addresses the need for blocking the gap between the panel pet door and the partially closed screen door as described above. As a result of this invention, which in one embodiment may act as a barrier, bugs/insects (such as mosquitoes, flies, lizards, spiders, etc.) and leaves, etc. are blocked from entering the home while allowing the sliding door to remain open for the exchange of air into and out of the home. FIG. 2 illustrates one embodiment blocking the gap between the screen door and the panel pet door with a projecting flange 7, also referred to as a barrier.

In one embodiment, the barrier 7 is made of a flexible material to give a soft and quiet contact to the screen door when closed and to accommodate variation in the contact of the screen door to the barrier by bending to provide a seal throughout the length of the barrier. In another embodiment, the invention is in a pre-flexed shape so when the screen door is closed and in contact with the invention, the shape bends, but not to the extent that it gives the appearance of bending too far backwards.

In a further embodiment, stiffening ribs exist on the backside of the projecting flange (the side opposite from where the screen door contacts) to provide additional rigidity for the purpose of reducing waviness.

BRIEF DESCRIPTION OF THE DRAWINGS

The features, objects, and advantages of the present invention will become more apparent from the detailed description set forth below when taken in conjunction with the drawings, in which like reference characters identify correspondingly throughout and wherein.

DETAILED DESCRIPTION OF EXEMPLARY EMBODIMENTS

Disclosure Overview

Figure 1:
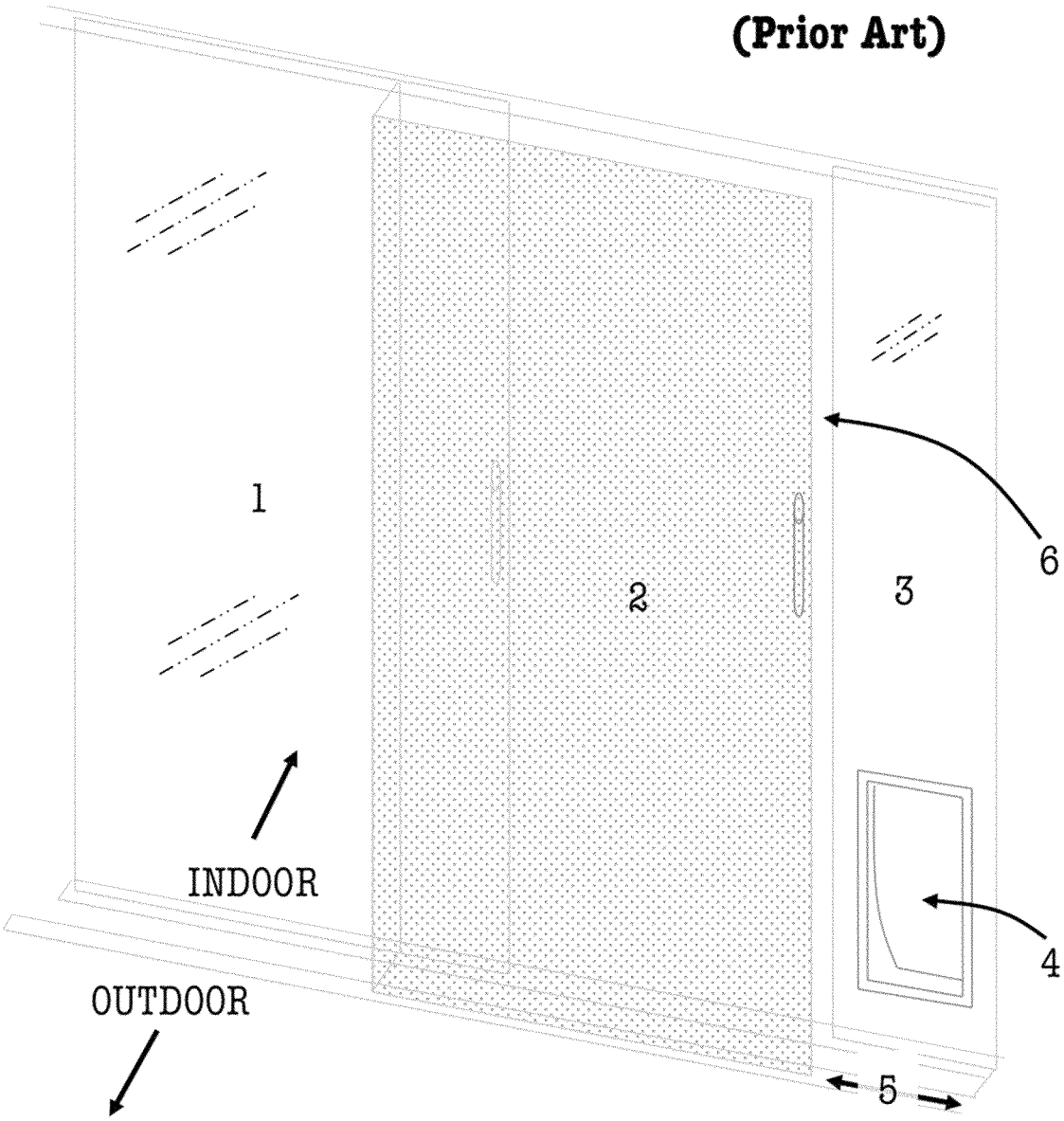
FIG 1 (Prior Art)
FIG. 1 depicts a typical scenario prior to the installation of the invention.
Figure 2:
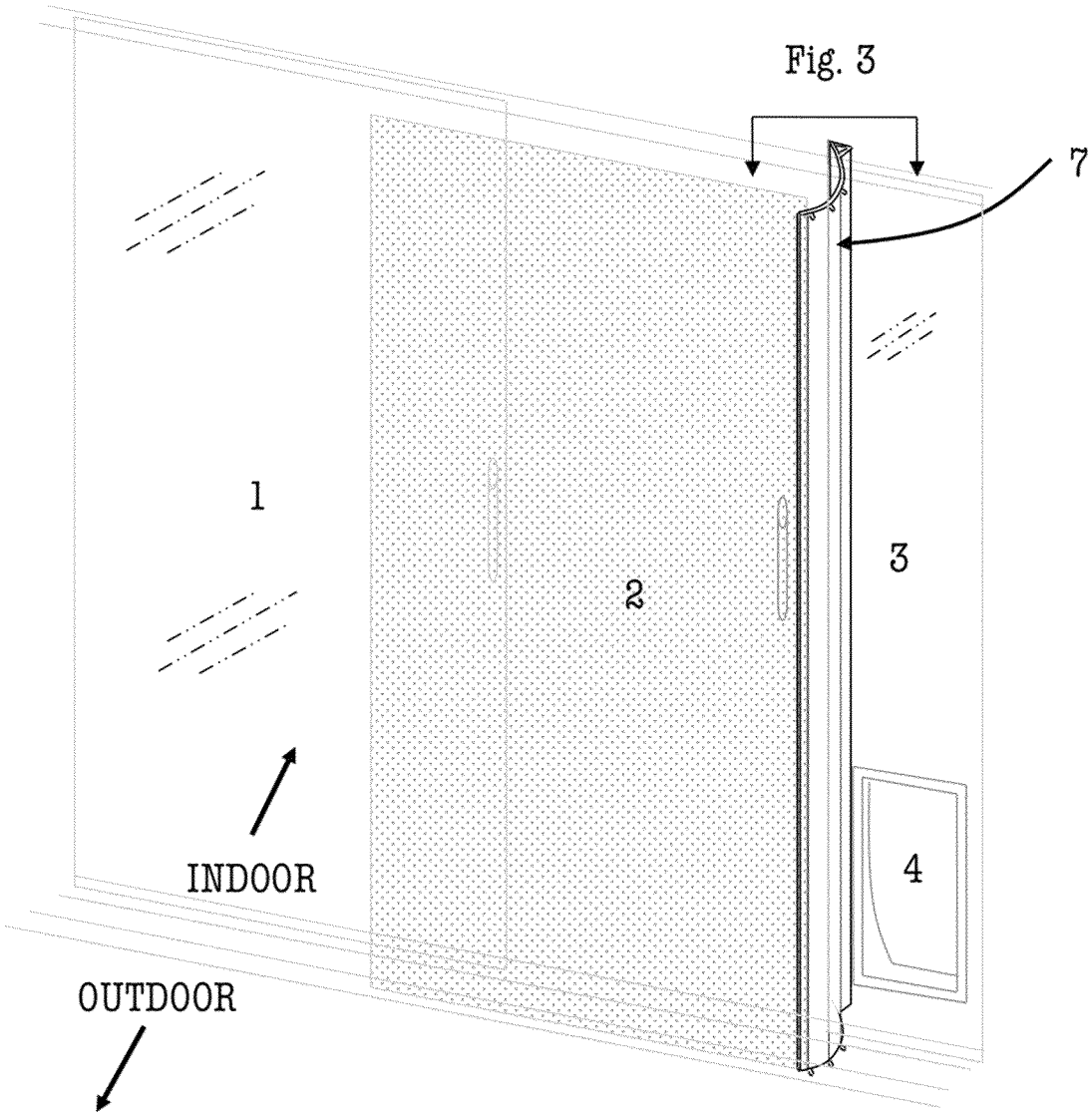
FIG. 2 depicts a typical panel pet door/sliding door/screen door installation with one embodiment of the projecting flange installed and blocking the gap.

As a result of the gap caused by the installation of panel pet doors, there is a need for a solution that blocks this gap. The solution is provided by this invention. FIG. 2 illustrates one embodiment of the invention installed between a panel pet door/sliding door/screen door arrangement so as to block the gap. In one embodiment, a projecting flange is used as a barrier. In a further embodiment, the projecting flange 7 may be constructed of a flexible material to accommodate variation in the contact of the screen door to the invention by bending to provide a continuous seal throughout the length of the invention.

In yet another embodiment, the projecting flange or barrier may be in a pre-flexed shape so when the screen door is closed and in contact with the invention the shape bends, but not to the extent that it gives the appearance of bending too far backwards. In another embodiment, the base of the projecting flange 7 or barrier (the bottom portion attaching to the panel pet door) provides additional rigidity to minimize flexion, which would otherwise increase undesirable waviness down the length of the invention. Excess waviness provides small openings between the invention and the screen door allowing small bugs/insects or debris to enter.

In another embodiment, stiffening ribs may be provided on the backside of the projecting flange or barrier (the side opposite from where the screen door contacts) to provide additional rigidity for the purpose of reducing waviness.

As is known in the industry, the gap size between the screen door and the panel pet door may vary from one door to the next. The projecting flange or barrier 7 may be provided with multiple guide lines of separation, as shown in the embodiment at locations 102 (3 places in this embodiment), for easy customization with scissors, or any other cutting device, to match the reach of the projecting flange to the gap size between a screen door and panel pet door.

Figure 3:
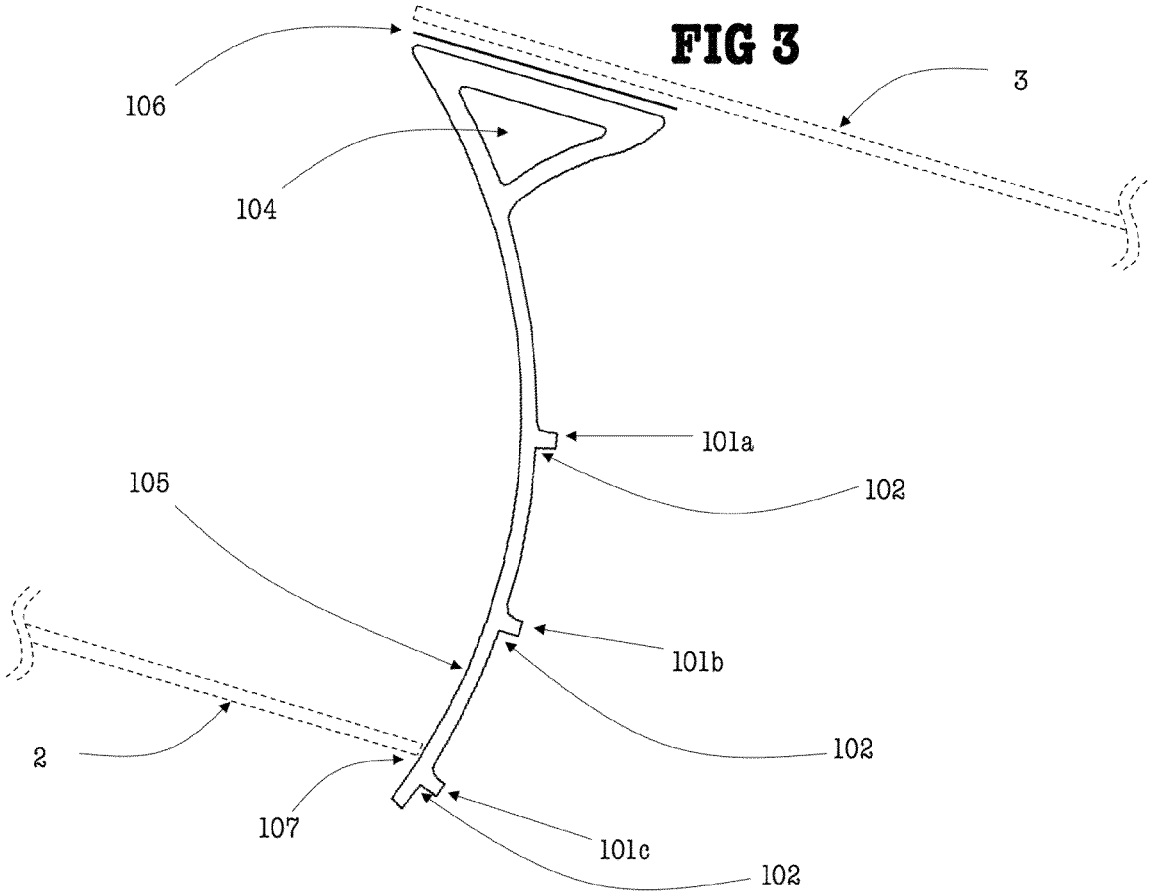
FIG. 3 depicts a cross-sectional top-down view of one embodiment of the projecting flange as depicted in FIG. 2.
Figures 4, 5:
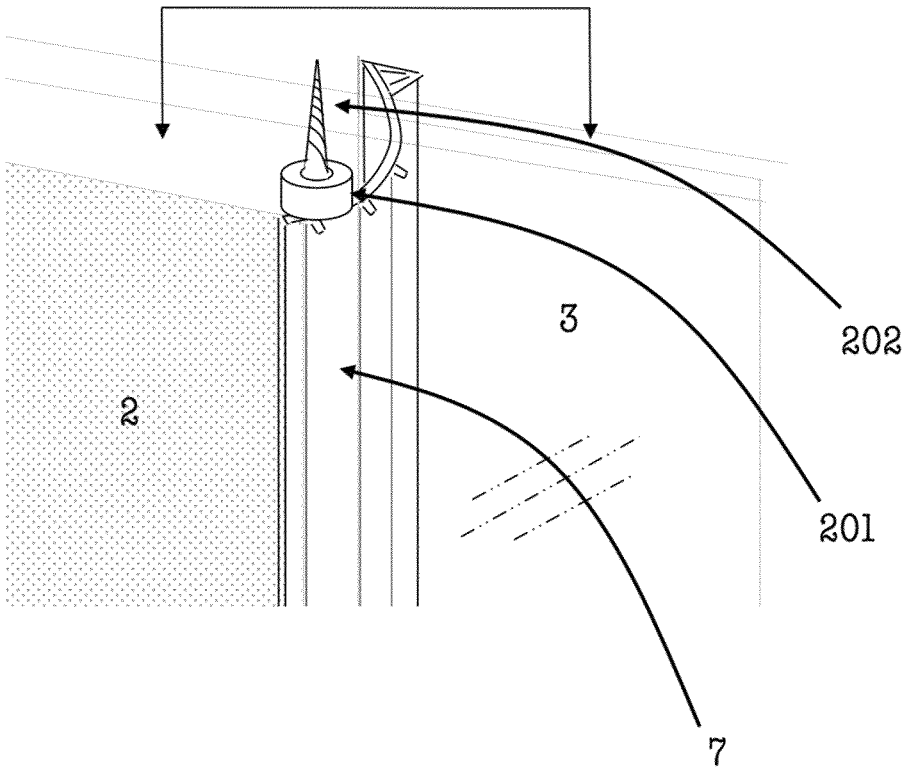
FIG. 4 depicts a zoomed in view showing one embodiment of the stopping device.
FIG. 5 depicts a top-down view of one embodiment of the barrier showing the screen door stopping device as depicted in FIG. 4.
Figure 5:
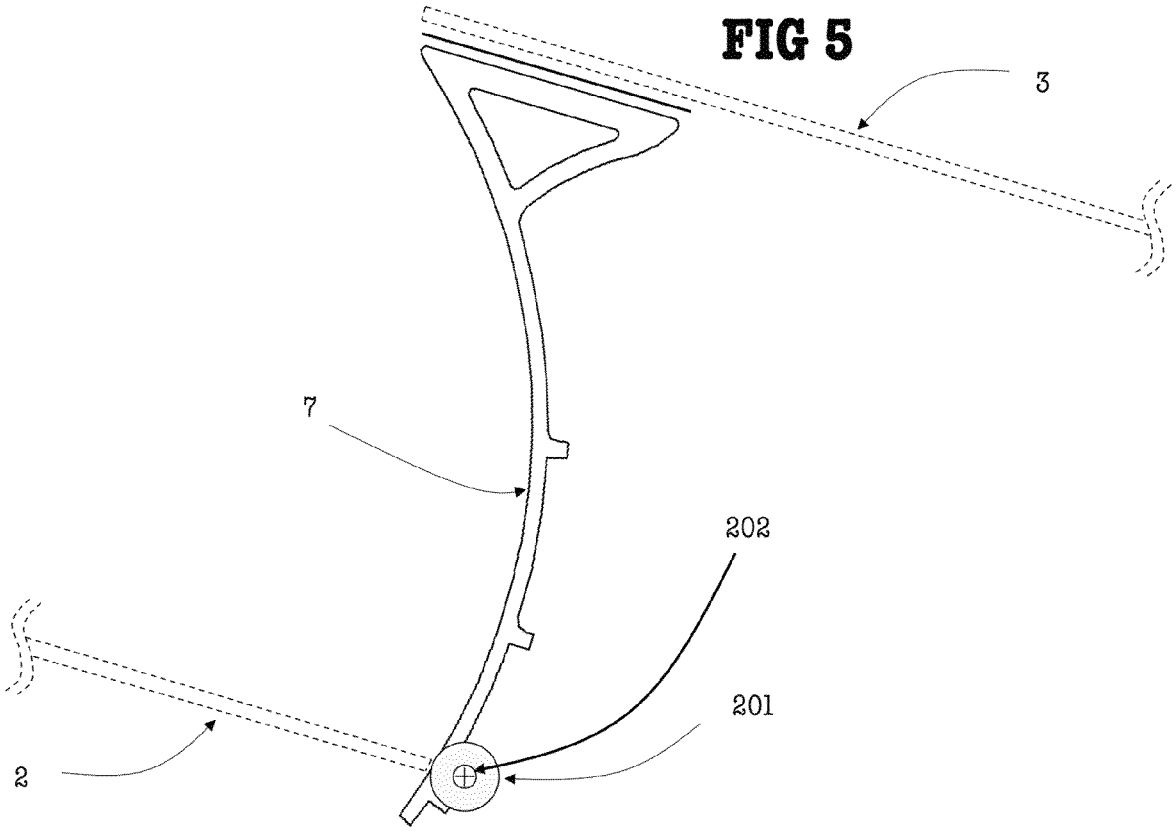

FIG. 3 depicts a cross-sectional top-down view of one embodiment of the invention as depicted in FIG. 2. As shown in FIG. 3, one or more ribs (also referred to as ridges) (101*a*, 101*b*, 101*c* . . . ) generally referred to as ribs 101 occur on the backside (opposite the side where the screen door contacts the invention) in this embodiment. Three ribs are shown in this embodiment of the invention. These ribs provide additional rigidity to minimize waviness along the length of the invention.

The base of one embodiment of the invention includes a hollow closed loop 104, triangular in this embodiment, to provide additional rigidity while keeping the weight to a minimum. The additional rigidity minimizes undesirable waviness, which would otherwise allow bugs/insects and undesirable extraneous material such as leaves to enter through narrow gaps.

Tests were performed with earlier prototypes, demonstrating a flat cross-sectional shape (instead of curved as shown in the "blade" 105) would allow for excessive waviness in some scenarios down the length (perpendicular to the cross section) of the barrier due to manufacturing, shipping or other causes. Increased waviness creates intermittent small openings at location 107, enabling small bugs/insects to fly into or otherwise enter the home. To correct this small opening problem, the side of one embodiment of the blade of the barrier facing the screen door 2 has a curvature 105 extending to establish contact with the screen door when closed to seal these gaps. The curvature of this embodiment provides additional rigidity, beyond what a flat surface could provide, to minimize waviness, thereby reducing small gap openings. Although a flat cross-sectional shape would be acceptable in some embodiments, it may be less desirable in other embodiments where minimizing waviness is important. To further minimize small gaps, the material of one embodiment is designed with flexibility to provide contact throughout the length despite the inherent waviness resulting from manufacturing, and to minimize the contact sound when closing the screen door to contact the invention. When the screen door is closed, the material of this embodiment flexes to reduce waviness while aligning to form continuous contact with the screen door. In some embodiments, a rigid material would also be acceptable.

To minimize the risk of injury when accidentally bumping into the invention when a person walks in or out through the sliding door, the flexible material of some embodiments is selected to flex instead of causing injury as a rigid embodiment might.

In one embodiment, attachment of the projecting flange or barrier 7 to the panel pet door may be performed with dual-sided tape 106.

A stopping device, consisting of 201 and 202 in one embodiment, may be inserted into the frame where the sliding screen door slides, to prevent closing the screen door beyond the projecting flange or barrier 7. In some embodiments, the stopping device may not be required. One embodiment of the stopping device consists of a washer 201, also referred to as a spacer, made of a material softer than metal, such as nylon, that is installed into the top or bottom rail of the sliding door. In one embodiment of the stopping device, the nylon washer is held in place by inserting a screw 202 through the washer and into the frame where the sliding door slides.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner on one or more embodiments without limitation.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Trademarks and copyrights referred to herein are the property of their respective owners.

What is claimed is:

1. In a sliding door system having a sliding door, a screen door, and a pet door panel, each of the sliding door, screen door and pet door panel being disposed within a door frame, the sliding door being adapted to translate within a sliding door plane and the screen door being adapted to translate within a screen door plane, the sliding door plane being disposed parallel with the screen door plane and having a gap extending therebetween, and the pet door panel being fixed within the sliding door plane at a side adjacent to the sliding door, an improvement comprising:

a flange configured to seal the gap between the pet door panel and the screen door for preventing entry of unwanted pests and debris therethrough, the flange comprising:

a base extending from a bottom end to a top end along a length of the flange, a cross-section of the base having a triangular shape, the base being configured to attach with at least one surface of the pet door panel; and a body portion extending outwardly from the base and configured to abut the screen door, the body portion comprising an arced surface for increased rigidity and improved contact with the screen door.

2. The improvement of claim 1, at least a portion of the base comprising a hollow triangular cross-section for providing increased rigidity to weight ratio of the flange.

3. The improvement of claim 1, the base comprising a double-sided tape for attaching with the pet door panel.

4. The improvement of claim 1, the flange comprising a rigid volume.

5. The improvement of claim 1, further comprising a stopping device, the stopping device configured to be disposed about an interior surface of the sliding door system and within the screen door plane such that the stopping device is positioned for abutting the screen door at a closed position thereof, wherein the screen door is sealed with the flange when in the closed position.

6. The improvement of claim 1, the flange comprising at least one rib extending along a length of the flange.

7. The improvement of claim 6, wherein the flange comprises a plurality of ribs.

8. The improvement of claim 7, wherein a first rib of said plurality of ribs is positioned at a first distance from the base, and a second rib of said plurality of ribs is disposed at a second distance from the base that is greater than the first distance, wherein each of the first distance and second distance are configured to correspond to a first gap size and a second gap size for providing a means to trim the flange along one of said ribs for configuring the thickness of the body portion to any of a plurality of standard gap sizes.

9. A barrier device, comprising:

a flange configured to seal a gap disposed between a pet door panel installed within a first sliding door track and a sliding door installed within a second sliding door track of a sliding door system, the second sliding door track being disposed parallel and offset from the first sliding door track within the system, the flange comprising:

a base extending from a bottom end to a top end along a length of the flange, the base being configured to attach with at least one surface of the pet door panel; and a body portion extending outwardly from the base, the body portion having an arced surface and being configured to contact a surface of the sliding door.

10. The barrier device of claim 9, wherein the body portion extending from the base forms an acute angle therebetween.

11. The barrier device of claim 9, wherein the body portion comprises one or more ribs extending along the length of the flange, each of said ribs being individually positioned at a distance from the base, wherein a first rib of said ribs is disposed at a first distance from the base and a second rib of said ribs is disposed at a second distance from the base that is greater than the first distance, and each of the ribs extends perpendicularly outward from the arced surface of the body portion.

12. The barrier device of claim 11, wherein the body portion does not include a flat surface.

13. The barrier device of claim 11, wherein the base comprises a triangular cross section extending along the length of the flange.

14. In a sliding door system having a first sliding door configured to translate within a first plane, and a second sliding door configured to translate within a second plane, the first plane being disposed parallel with the second plane, and the first sliding door being separated from the second sliding door by a gap disposed therebetween, a pet door system, comprising:

a pet door panel comprising a panel configured to install within the first plane of the sliding door system, the panel having a pet door disposed near a bottom portion thereof; and a flange, the flange comprising at least a base and a body portion, the base being disposed along a length of the pet door panel from a bottom end to a top end thereof, and the body portion extending outwardly from the base and through the gap to form a seal with the second sliding door.

15. The pet door system of claim 14, further comprising a stopping device, the stopping device being disposed about an interior surface of a door frame within the second plane such that the stopping device is positioned for abutting the second sliding door at a closed position thereof, wherein the second sliding door is forms a seal with the flange when in the closed position.

16. The pet door system of claim 14, said flange comprising at least one rib, said rib extending along the length of the body portion at a distance from the base.

17. The pet door system of claim 16, comprising a first rib and a second rib, the first rib being disposed at a first distance from the base of the flange, and the second rib being disposed at a second distance from the base of the flange, wherein the first distance is less than the second distance.

18. The pet door system of claim 16, said flange comprising three ribs.

19. The pet door system of claim 16, each of said ribs extending perpendicularly outward from the body portion of the flange.

20. The pet door system of claim 19, wherein the body portion of the flange comprises an arced surface for improved rigidity and sealing with the second sliding door.

* * * * *